US005994978A

United States Patent [19]

Vangala

[11] Patent Number: 5,994,978

[45] Date of Patent: Nov. 30, 1999

[54] PARTIALLY INTERDIGITATED COMBLINE CERAMIC FILTER

[75] Inventor: Reddy Vangala, Albuquerque, N.Mex.

[73] Assignee: CTS Corporation, Elkhart, Ind.

[21] Appl. No.: 09/024,207

[22] Filed: Feb. 17, 1998

[51] Int. Cl.[6] ..... H01P 5/12; H01P 1/205

[52] U.S. Cl. ..... 333/134; 333/206; 333/203

[58] Field of Search ..... 333/202, 206, 333/207, 203, 126, 134

[56] References Cited

U.S. PATENT DOCUMENTS

| | | | |
|---|---|---|---|
| 4,829,274 | 5/1989 | Green et al. | 333/202 |
| 5,379,011 | 1/1995 | Sokola et al. | 333/206 |
| 5,488,335 | 1/1996 | Agahi-kesheh et al. | 333/206 |
| 5,502,422 | 3/1996 | Newell et al. | 333/207 |
| 5,512,866 | 4/1996 | Vangala et al. | 333/134 |
| 5,537,082 | 7/1996 | Tada et al. | 333/207 X |
| 5,537,085 | 7/1996 | McVeety | 333/206 |
| 5,712,648 | 1/1998 | Tsujiguchi | 333/134 X |

FOREIGN PATENT DOCUMENTS

| | | | |
|---|---|---|---|
| 57-148403 | 9/1982 | Japan | 333/134 |
| 62-38601 | 2/1987 | Japan | 333/202 |
| 62-154801 | 7/1987 | Japan | 333/202 |
| 63-278401 | 11/1988 | Japan | 333/202 |
| 5-175703 | 7/1993 | Japan | 333/202 |

*Primary Examiner*—Seungsook Ham
*Attorney, Agent, or Firm*—Jones, Day, Reavis & Pogue

[57] ABSTRACT

A partially interdigitated combline ceramic filter is provided. The filter has a filter body with top, bottom, and side surfaces, and metallized through-holes defining quarter-wavelength resonators. The filter also has a metallization layer and at least one combline section with at least one transmission zero between the quarter-wavelength resonators. The filter also has at least one interdigital section and a coupling means between the quarter-wavelength resonators of the interdigital section. The filter also has first and second input-output pads. The partially interdigitated combline ceramic filter has the best attributes of both interdigital filter designs and combline filter designs to provide a filter which has transmission zeros, superior stopband rejection, and good harmonic performance in a small, compact, low-profile package that does not require external shielding.

15 Claims, 6 Drawing Sheets

PARTIALLY INTERDIGITATED COMBLINE CERAMIC FILTER

FIELD OF THE INVENTION

This invention relates to dielectric ceramic block filters and more particularly, to a partially interdigitated combline ceramic filter.

BACKGROUND OF THE INVENTION

Filters are known to provide attenuation of signals having frequencies outside of a particular frequency range and little attenuation to signals having frequencies within the particular range of interest. As is also known, these filters may be fabricated from ceramic materials having one or more resonators formed therein. A ceramic filter may be constructed to provide a lowpass filter, a bandpass filter, or a highpass filter, for example.

Ceramic filters typically employ quarter-wavelength type resonators with one end electrically open and the other end shorted to ground in combline like design. This design offers compact size and rugged construction in a slim, low-profile component. Moreover, this design offers transmission zeros between pairs of resonators and only requires a printed pattern on one surface of the filter block.

FIG. 1 shows a ceramic filter with a combline design, representative of the prior art. A filter 100 is provided which has resonators 102. The resonators 102 are said to have a combline design because they are both open-circuited at one end 104 and short-circuited at the other end 106. FIG. 2 shows a schematic of the electrical circuit that corresponds with filter 100. Referring to FIG. 2, resonators 102 are provided. The combline coupling 108 is shown inside the dashed-line box. In a combline filter design, the inter-resonator coupling is described as a series connected short circuited stub. Combline coupling is well known in the art.

One disadvantage of the traditional combline design, however, is the fact that these block filters oftentimes require an external metallic shield attached to the open-circuited end of the block in order to minimize the parasitic coupling between non-adjacent resonators and to achieve acceptable stopbands and satisfactory harmonic performance. Filter designers expand much effort in designing a shield which is compatible with the block design and is easily manufacturable and attachable. Such shields are typically stamped from sheet metal and attached by a soldering operation.

Another design alternative involves the use of an interdigital resonator design in the dielectric block of ceramic. Interdigital resonator designs allow full quarter-wavelength designs which provide higher electrical Q, an important property related to loss. Whereas a block filter with an interdigital resonator design does not typically require a metallic shield, it does create other design challenges. For example, the strong inter-resonator coupling associated with this design necessitates large spacings between the resonators for narrow-band filter designs. This may lead to filters which are undesirably large in volume. Additionally, the transmission zeros between the pair of resonators, which is found in the combline filter design, is not found in the interdigital design. Transmission zeros are important to obtain a highly selective frequency response in the compact filters needed for modern communication equipment.

FIG. 3 shows a ceramic filter with an interdigital design, representative of the prior art. A filter 300 is provided which has resonators 302. The resonators 302 are said to have an interdigital design because they are each open-circuited at opposite ends 304 of the filter block. Similarly, the resonators are each short-circuited at opposite ends 306 of the filter block, creating the interdigital design. FIG. 4 shows a schematic of the electrical circuit that corresponds with filter 300. Referring to FIG. 4, resonators 302 are provided. The interdigital coupling 308 is shown inside the dashed-line box. In an interdigital filter design, the inter-resonator coupling is described by a series transmission line. Interdigital coupling is also well known in the art.

A ceramic filter design which exploited the best attributes of both interdigital filter designs and combline filter designs to provide a filter which has transmission zeros, superior stopband rejection, and good harmonic performance in a small, compact, low-profile package that did not require an external metal shield would be considered an improvement in the art.

DETAILED DESCRIPTION OF THE PREFERRED EMBODIMENT

Figure 1:
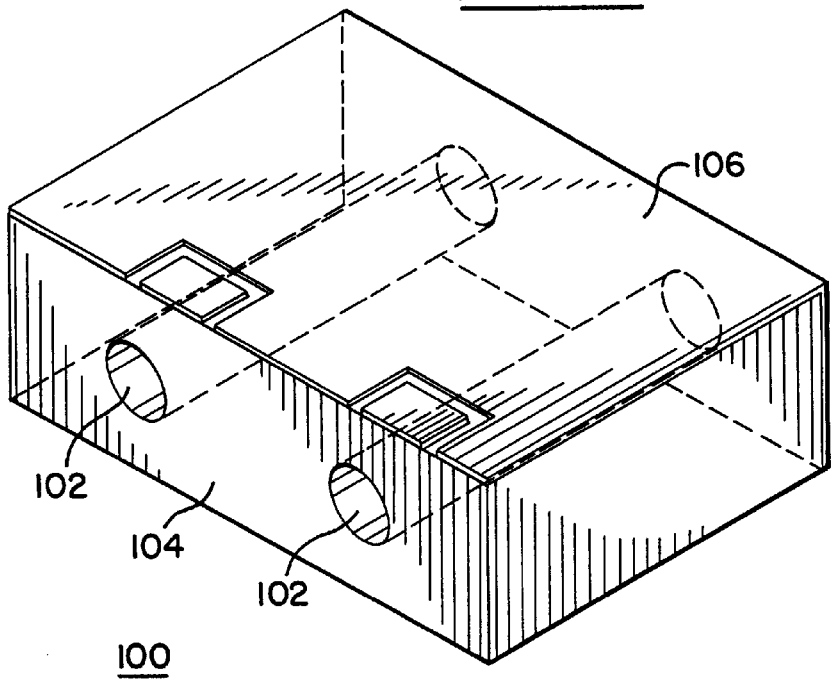
FIG. 1 PRIOR ART
FIG. 1 shows a ceramic block filter with a combline resonator design in accordance with the prior art.
Figure 2:
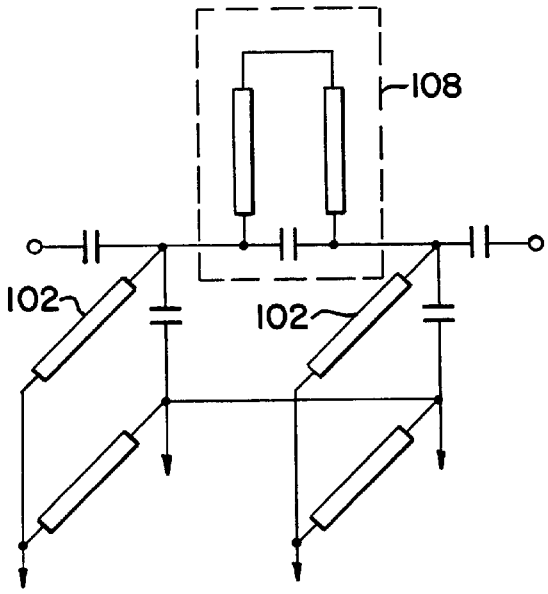
FIG. 2 PRIOR ART
FIG. 2 shows a schematic of the ceramic block filter with a combline resonator design shown in FIG. 1 in accordance with the prior art.
Figure 3:
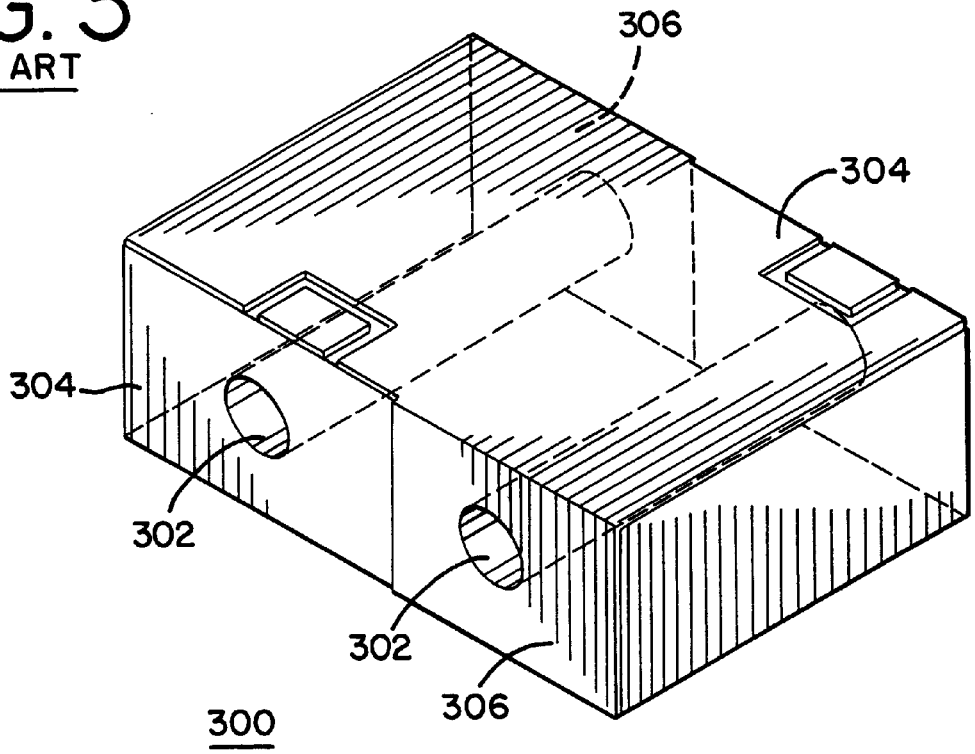
FIG. 3 PRIOR ART
FIG. 3 shows a ceramic block filter with an interdigital resonator design in accordance with the prior art.
Figure 4:
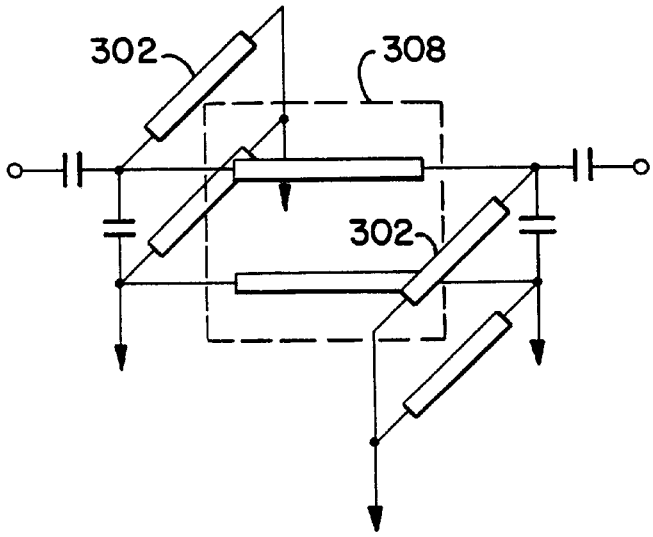
FIG. 4 PRIOR ART
FIG. 4 shows a schematic of the ceramic block filter with an interdigital resonator design shown in FIG. 3 in accordance with the prior art.
Figure 5:
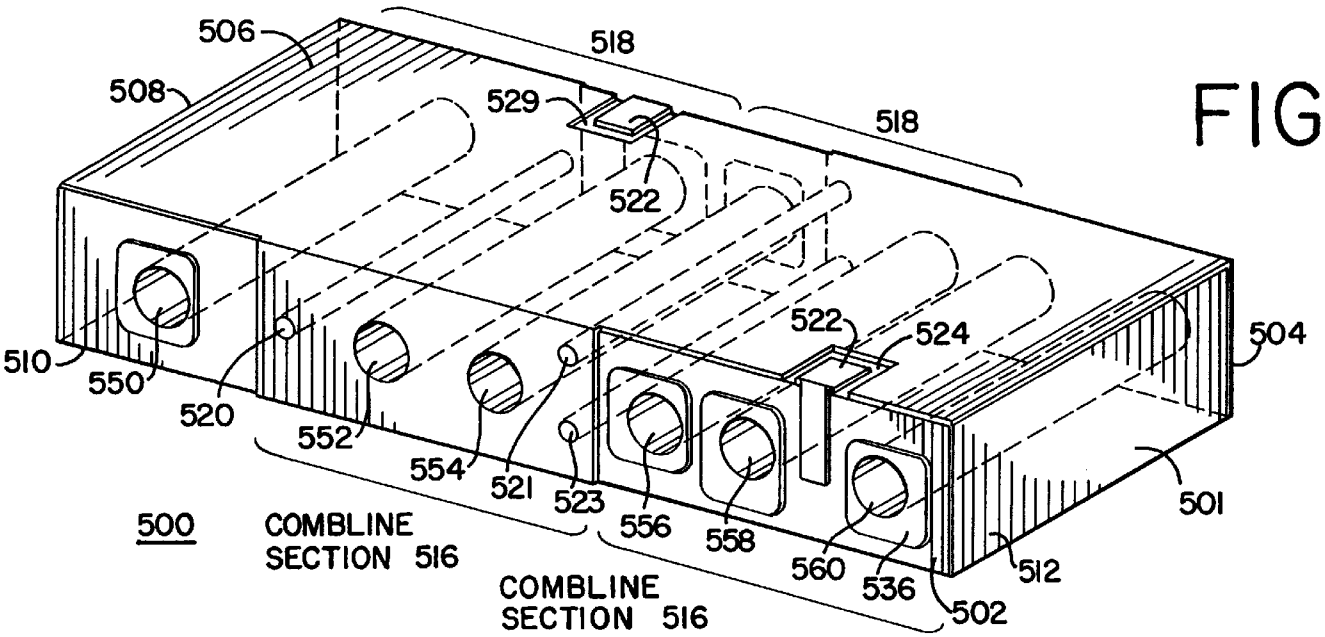
FIG. 5 shows a partially interdigitated combline ceramic filter in accordance with the present invention.

FIG. 5 shows a partially interdigitated combline ceramic filter 500. Referring to FIG. 5, a filter body comprising a block of dielectric material 501 having a top surface 502, a bottom surface 504, and side surfaces 506, 508, 510 and 512 is provided. A plurality of metallized through-holes extending from the top surface 502 to the bottom surface 504 define quarter-wavelength resonators 550, 552, 554, 556, 558, and 560 respectively.

A metallization layer substantially coating the top surface 502, the bottom surface 504, and the side surfaces 506, 508, 510, and 512, with an exception that predetermined portions of the top surface 502 and the bottom surface 504 are unmetallized is also provided.

Filter 500 contains resonator pairs 550 and 552, as well as 554 and 556, placed into the dielectric block 501 in an interdigital design so as to create interdigital sections 518. Furthermore, resonators 552, 554, as well as 556, 558, and 560 are placed into the dielectric block 501 in a combline design so as to create combline sections 516. One metallized ground-hole 520 between resonators 550 and 552 allows those resonators to brought closer together thereby reducing the external dimensions of the filter 500. Similarly, a pair of ground-holes 521, 523 are strategically placed between resonators 554 and 556 to further reduce the size of the filter 500.

Figure 6:
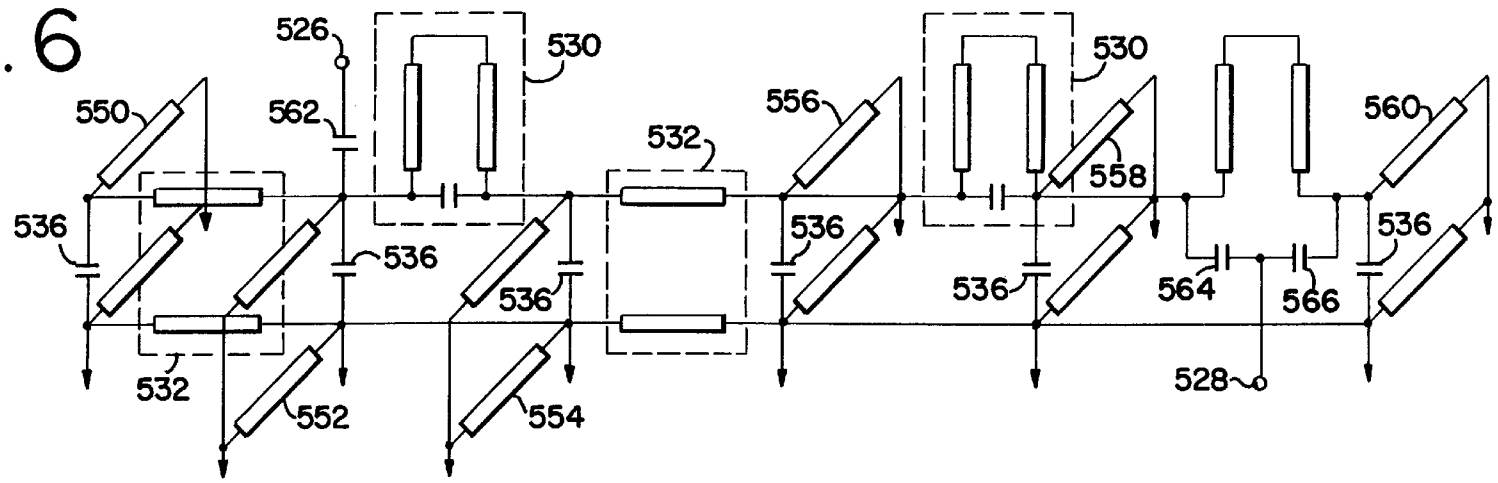
FIG. 6 shows a schematic of the partially interdigitated combline ceramic filter shown in FIG. 5 in accordance with the present invention.

Referring now to FIG. 5 in conjunction with its corresponding schematic in FIG. 6, one series transmission zero can be realized between resonators 552 and 554 and a second series transmission zero is obtained between resonators 556 and 558. Resonator 550, combined with the interdigital coupling section 532 (see FIG. 6) may place a short-circuit across the signal path forming an additional transmission zero. This is due to the fact that the quarter wavelength of resonator 550 and the quarter wavelength of interdigital coupling section 532 together add up to a half wavelength and the short circuit at the end of resonator 550 will reflect as a short circuit across the input terminal (526 in FIG. 6) of filter 500. This type of transmission zero is described as a shunt connected interdigital transmission zero.

Similarly, resonator 560 together with capacitors 536 and 566 (see FIG. 6) forms a series resonant circuit across the output terminal (528 in FIG. 6) of filter 500. At a predetermined frequency, this shunt connected series resonant circuit forms a short circuit across the filter output adding another transmission zero. This type of zero is known as a shunt connected combline transmission zero. Each of these transmission zeros may be at a certain predetermined frequency so as to improve stopband rejection performance of filter 500.

A further advantage of this filter design is the fact that the interdigital sections 518 and the combline sections 516 are alternately disposed in the block 501. Stated another way, the block begins at one end with an interdigital section which then becomes a combline section which then again becomes an interdigital section which finally becomes a combline section. Such an arrangement advantageously distributes the ground plane between the top surface 502 and the bottom surface 504 which effectively eliminates the parasitic couplings between non-adjacent resonators, thereby eliminating the need for external metal shields. Such metal shields are normally needed in combline filters to improve out-of-band rejection performance.

Filter 500 also has first and second input-output pads 522 comprising an area of conductive material on one of the side surfaces and substantially surrounded by an unmetallized area 524.

FIG. 6 shows a schematic of the partially interdigitated combline ceramic filter shown in FIG. 5. Resonators 550, 552, 554, 556, 558 and 560 are shown to be paired transmission lines. Electrical input 526 and electrical output 528 are also provided. Capacitors 562, 564, and 566 are due to the coupling from the first and second input-output pads 522 to resonators 552, and 558, 560 respectively. Shunt connected transmission zero end resonator 560 is also provided. Notably, combline coupling 530, whereby the inter-resonator coupling is described as series connected short circuited stubs is shown between certain resonators. Also, interdigital coupling 532, whereby inter-resonator coupling is characterized by series transmission lines, is shown between other resonators. Loading capacitors 536, which allow the resonators to be shorter than one quarter wavelength, are also shown in FIG. 6. A loading capacitor 536, in the form of a printed pattern on top surface 502, is also shown in FIG. 5. The result is a partially interdigitated combline ceramic filter.

The present invention is particularly well suited for high frequency applications. More specifically, a trend in the wireless telecommunications field involves equipment that operates at higher and higher frequencies and which requires filters that are smaller in volume, contain less material, have smaller footprints, and have a lower profile on the circuit board, while still providing high performance and meeting increasingly stringent specifications.

The present invention advantageously provides a high performance front end filter capable of operating at high frequencies. Moreover, the by eliminating the need for an external shield, substantial processing steps may be eliminated. More importantly, however, the profile of the filter is substantially reduced, allowing the filter to fit snugly into next generation wireless equipment while simultaneously maintaining the desired performance characteristics such as high stopbands and transmission zeros.

As an example of how filtering requirements are moving up the frequency spectrum to higher frequencies, one is referred to the PCS (Personal Communication Systems) band of the spectrum which operates in the range of about 1800–1900 MHz. At these frequencies, the performance specifications are challenging to meet in conjunction with the size constraints. The partially interdigitated combline filter helps meet the specifications while simultaneously meeting the filter package size constraints. In one embodiment of the present invention, the partially interdigitated combline ceramic filter is disposed in an electronic device operating at about 1800 MHz or above.

Although combline filters have the advantages of compact size and sharp selectivity due to the transmission zeros between adjacent resonators, they also oftentimes require external shields to realize sharp selectivity in high performance filters such as those used with the Personal Communications System (PCS). Interdigital filters, on the other hand, do not require an external shield, but do tend to be twice as long, compared to combline filters, for certain narrowband filter applications. The proposed scheme, a partially interdigitated combline ceramic filter, integrates the two topologies to enable ample transmission zeros for sharp selectivity and ample ground planes to eliminate the need for an external shield. Ground holes are inserted in order to keep the size comparable to that of a combline filter design.

Stated another way, the partially interdigitated combline ceramic filter does more than merely eliminate a heavy, cumbersome shield. The present invention uniquely combines the best features of both the interdigital and combline filter design to achieve a geometry and metallization scheme which is repeatable in large scale manufacturing operations and which significantly allows the realization of transmission zeros, a much needed feature in high performance front end filter applications.

The transmission zeros created by the unique design of the present invention is an important aspect of this invention. Transmission zeros are important, and greatly aid a designer, because they provide improved selectivity in the filter response thus improve the overall performance of the filter. Traditionally, transmission zeros are created by the coupling between pairs of resonators in a combline filter design. Unfortunately, there is no equivalent transmission zero feature between resonator pairs with an interdigital design. Advantageously, the present invention provides combline type transmission zeros between the resonators of the interdigital portion of the partially interdigitated combline ceramic filter, thus offering greater design freedom and options to produce custom filters with unique specification requirements. In a preferred embodiment, the transmission zeros are created by the resonators adjacent to the end resonators in the dielectric block.

Another advantage of the design of the present invention is the ability to create traps of either a combline or interdigital nature. Traps, also referred to as shunt zeros, are important to a filter designer because they enhance stopband rejection and may provide sharper selectivity in the filter's frequency response. However, a trap in a combline filter design may be different from a trap realized in an interdigital design. The present invention advantageously allows traps to be incorporated at one or both ends of the dielectric filter block. Depending on the specific design of the filter, either interdigital or combline type traps may be realized on either or both ends of the filter depending on specification requirements.

The coupling phenomena which occur in a combline filter design is very different from the coupling that occurs in an interdigital filter design. As such, a challenge in the design of the present invention involves properly controlling the coupling between the resonators which comprise the interdigital portion of the filter while still maintaining the compact size of the filter. A designer has many methods by which this coupling may be controlled or even adjusted.

One method of adjusting the coupling involves offsetting the resonators such that they remain parallel, but are offset vertically. This may require changes to the external appearance, shape, and dimensions of the block (See FIGS. 7 and 8). In one embodiment of the invention, the resonator are offset to decrease the inter-resonator coupling in the interdigital section of the filter while maintaining resonator length.

Figure 7:
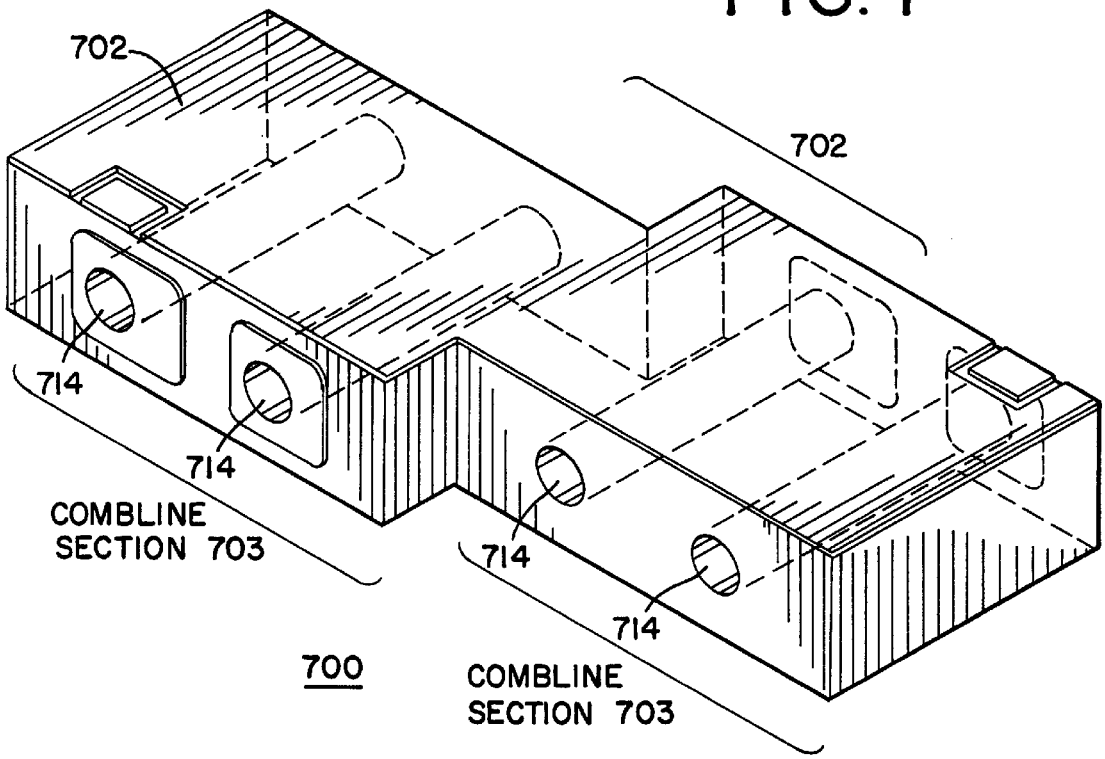
FIG. 7 shows another embodiment of a partially interdigitated combline ceramic filter in accordance with the present invention.

Referring to FIG. 7 , another embodiment of a partially interdigitated combline ceramic filter 700 in accordance with the present invention is provided. Filter 700 has many of the same features and characteristics as filter 500 in FIG. 5, discussed previously, and to the extent applicable, that discussion is incorporated herein by reference. Filter 700 has four resonators 714 through the block 701 of dielectric ceramic. One major difference between filters 500 and 700 is that the resonators of filter 700 which form the interdigital section 702 are offset from the resonators which form the combline section 703, thereby effectively de-coupling those resonators. This de-coupling is caused by the strategic placement of the resonators in an offset manner which results in a non-vertical alignment of the resonators, which causes the external shape of block 701 to appear stepped.

Figure 8:
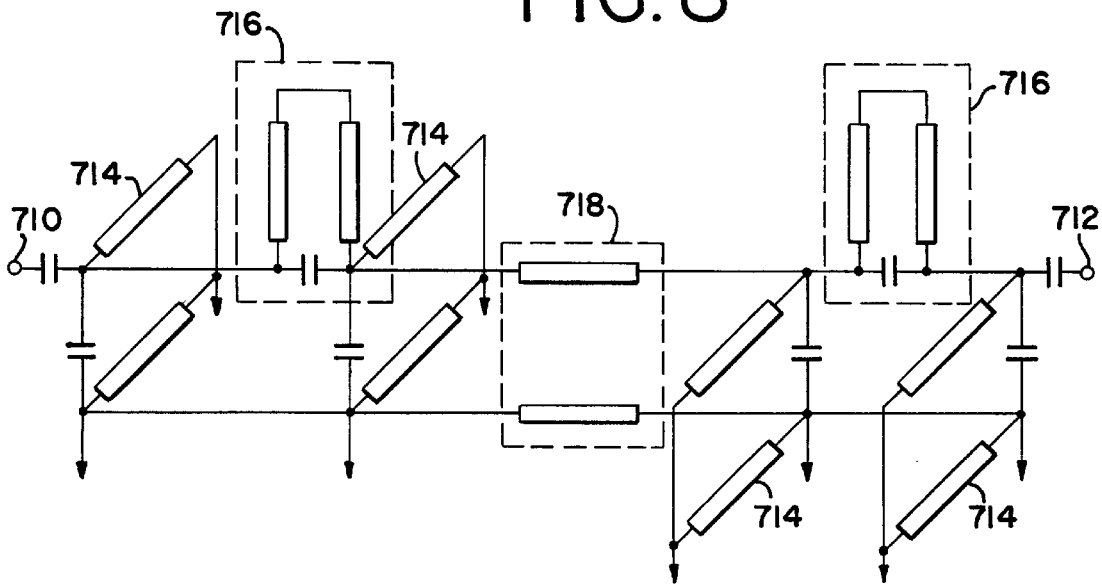
FIG. 8 shows a schematic of the partially interdigitated combline ceramic filter shown in FIG. 7 in accordance with the present invention.

FIG. 8 shows a schematic of the partially interdigitated combline ceramic filter shown in FIG. 7 in accordance with the present invention. Referring to FIG. 8, resonators 714 are aligned between an electrical input 710 and an electrical output 712. Significantly, combline coupling (see dashed boxes 716) occurs between some of the resonators 714 and interdigital coupling (see dashed box 718) occurs between others of the resonators 714 defining a partially interdigitated combline ceramic filter.

Other methods of adjusting the coupling involve the strategic placement of notches or ground-holes, on or even through the various surfaces of the dielectric block. Again, this will typically occur in the region in proximity to the interdigitated resonators. Ground-holes are typically smaller in diameter than the resonators, and are typically placed through the dielectric block, from the top to the bottom surfaces, in pairs. Ground-holes effectively control the coupling of the interdigital resonators while simultaneously reducing the size of the filters. Ground-holes, which may be circular, oval or even rectangular, effectively reduce the required spacing between interdigitated resonators. Since interdigitally designed filters are known to be undesirably large in volume for certain applications, the use of ground holes solves this problem, reduces the size of the filter, and does so in a way that can be easily repeated in large scale manufacturing operations.

The use of notches to control inter-resonator coupling between interdigitated resonators is still another design tool available to a filter manufacturer. Vertical notches, on the side surface of the filter blocks, approximately between the interdigital resonators, may be employed to reduce the overall length of the interdigitated section. Horizontal notches, on either the top or bottom surfaces of the filter block, between the interdigitated resonators is another method of achieving the same effect. Finally, inter-resonator coupling may also be obtained through the ceramic dielectric material or partly through the ceramic and partly augmented by external lumped elements such as capacitors or inductors.

Another aspect of this invention involves the addition of a loading capacitor at the open circuited end of the quarter-wavelength resonators. The loading capacitor may take the form of lumped external components or a gap capacitor formed by a printed conductor gap (see 536 in FIG. 5). The loading capacitor may also be embedded directly into the ceramic block. Moreover, the loading capacitors may be applied to either or both the combline section and the interdigital section and the loading capacitor is typically applied to the open-circuited end of the resonator.

The resonators of the partially interdigitated combline ceramic filter may be of varying length. In one embodiment of the present invention, shorter resonators may be compensated with greater loading capacitors. Still another design variable involves the use of non-uniform resonator diameters in the form of stepped or tapered resonator through-holes. Additionally, from an electrical perspective, all the resonators will be one-quarter wavelength by themselves or together with the loading capacitors.

Figure 9:
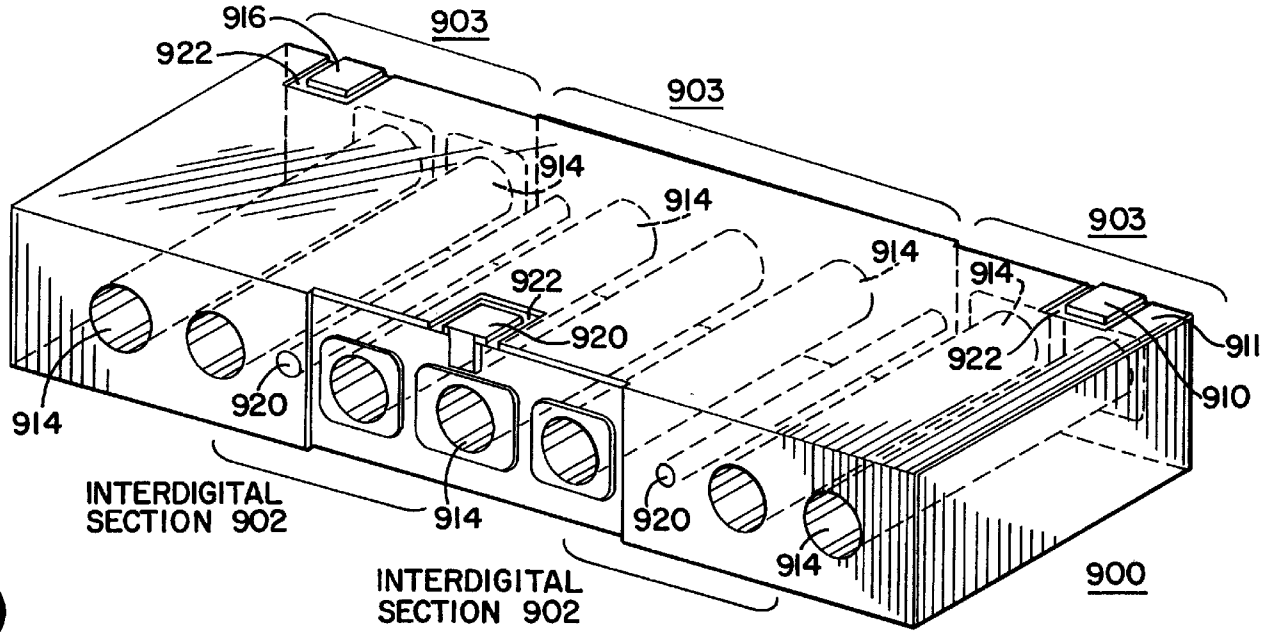
FIG. 9 shows an embodiment of a partially interdigitated combline ceramic duplexer filter in accordance with the present invention.
Figure 10:
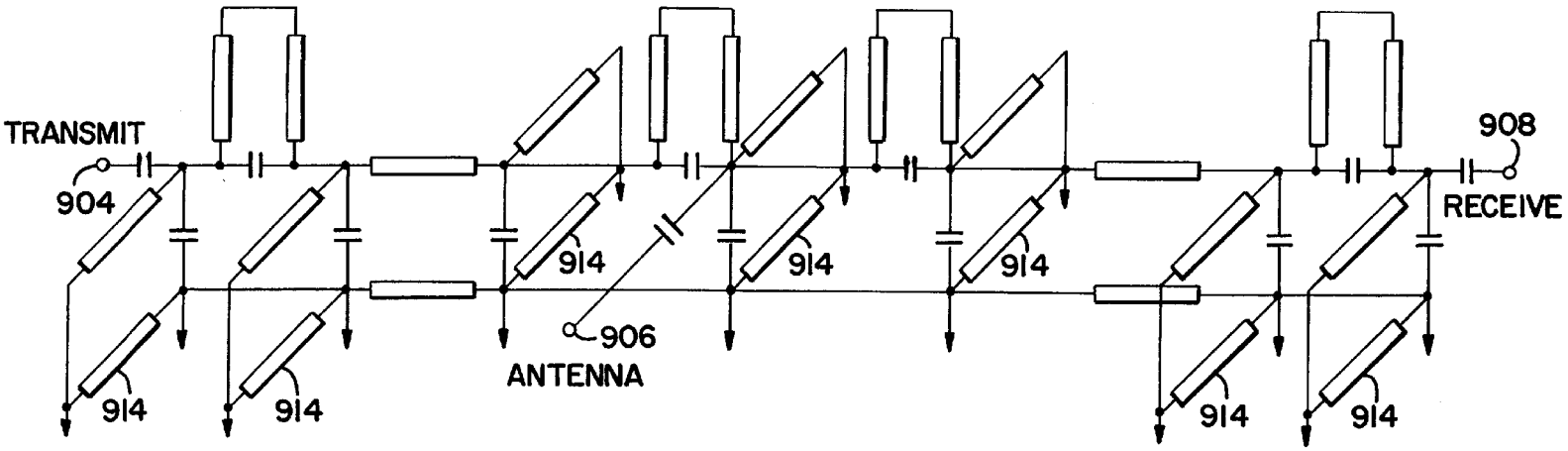
FIG. 10 shows a schematic of the partially interdigitated combline ceramic duplexer filter shown in FIG. 9 in accordance with the present invention.

FIGS. 9 and 10 show the partially interdigitated combline ceramic filter design applied to a duplexer filter and its corresponding electrical schematic. The combination combline-interdigital design has been discussed previously with regard to filters 500 and 700 shown in FIGS. 5 and 7 respectively. To the extent applicable, that discussion is incorporated herein by reference. FIG. 9 shows a ceramic duplexer filter 900 having the partially interdigitated combline ceramic filter design. Referring to FIG. 9, the duplex filter has seven resonators 914 and two ground-holes 920 which are located between the resonators of the interdigital section 902. Three separate combline sections 903 also appear on this duplexer filter.

A first transmit input-output pad 916 and a second receive input-output pad 910 and a third antenna input-output pad 920 comprising an area of conductive material on one of the side surfaces 911 and substantially surrounded by an unmetallized area 922 provide the duplexer filter 900.

FIG. 10 shows an electrical schematic of the filter shown in FIG. 9. Seven resonators 914 are shown between a transmit port 904 and a receive port 908. An antenna port 906 is also provided in the middle of the schematic. The schematic contains both combline-type coupling and interdigital-type coupling to provide a partially interdigitated combline ceramic filter.

An advantage of the present invention is that the combline section and the interdigital section may both be placed strategically at various locations in the dielectric block depending upon the required specifications and design options. For example, in one embodiment of the present invention, both end resonators are configured in an interdigital manner and the remaining resonators are configured in a combline manner and the end resonators provide the shunt connected interdigital transmission zeros (discussed previously) in the frequency response curve of the filter. In another embodiment, both end resonators are configured in a combline manner and the remaining resonators are configured in an interdigital manner and the end resonators provide the shunt connected combline transmission zeros (discussed previously) in the frequency response curve of the filter. In still another embodiment of the present invention, one of the end resonators is configured in an interdigital manner whereas the other end resonator is configured in a combline manner providing shunt connected interdigital and combline transmission zeros in the frequency response curve of the filter. In each embodiment described above, a partially interdigitated combline ceramic filter is realized which has a compact size and shape, and requires no burdensome external shield.

Figure 11:
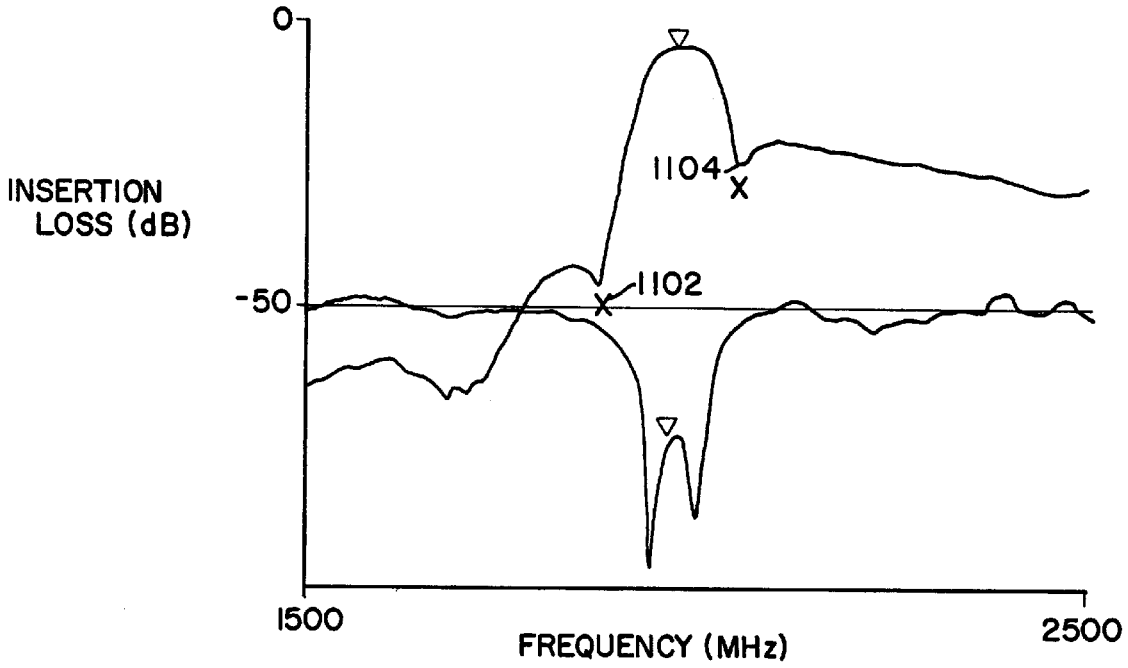
FIG. 11 shows a frequency response curve for the ceramic filter having a partially interdigitated combline design in accordance with the present invention.
Figure 12:
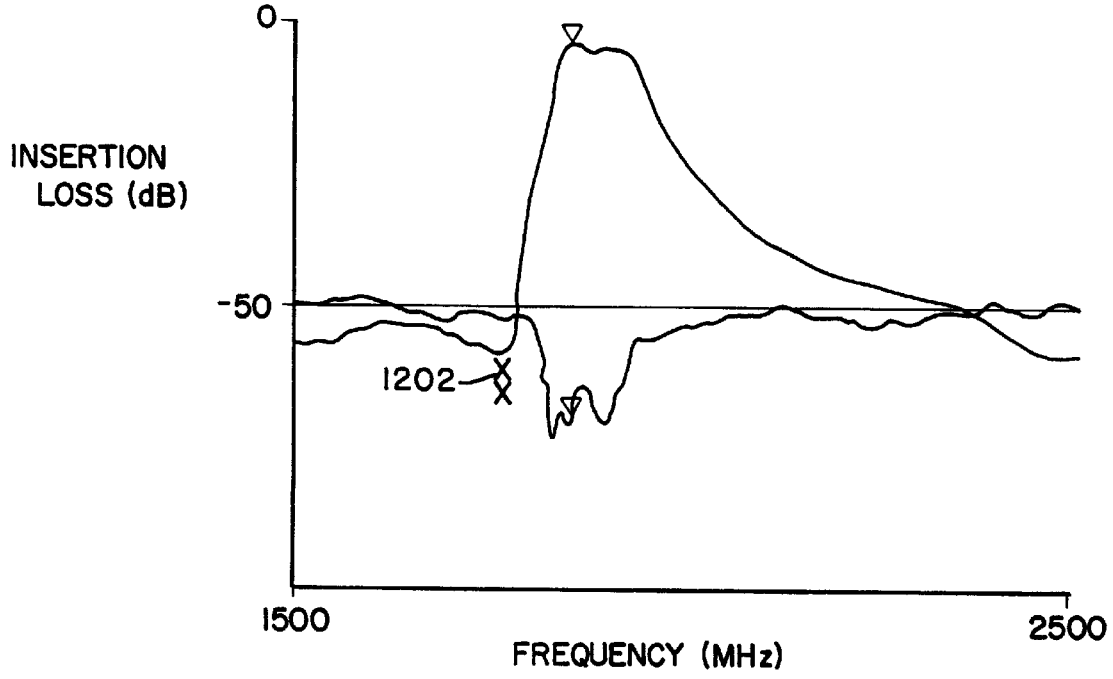
FIG. 12 shows a frequency response curve for another ceramic filter having a partially interdigitated combline design in accordance with the present invention.

The frequency response curves for a pair of partially interdigitated combline ceramic filters are shown in FIGS. 11 and 12. Referring to FIG. 11, a frequency response is provided having frequency measured in megahertz along the x-axis between 1500 MHz and 2500 MHz. Insertion loss, measured in dB, is provided along the y-axis and ranges between zero and −50 along the area of interest.

Analysis of FIG. 11 shows various interesting characteristics of the present invention. Foremost, the graph reveals that a viable filter response for a partially interdigitated combline ceramic filter may be achieved in the frequency range of interest. At PCS frequencies, for example, a bandwidth of about 60 MHz is realized. This is more than adequate for many telecommunication applications. Moreover, a low side transmission zero 1102 and a high side transmission zero 1104 are also present in the filter frequency response. These are important design capabilities. Also, FIG. 11 shows reasonable insertion loss values and good stopbands. Overall, FIG. 11 shows that the partially interdigitated combline ceramic filter, without external shielding, may still provide an acceptable filter response for many applications.

FIGS. 11 and 12 also show a filter frequency response curves for a filter similar to the one shown in FIG. 7 (having a partially interdigitated combline filter design but not shunt zeros on the end resonators). Frequency is also measured, in megahertz, along the x-axis. These values range from 1500 to 2500 MHz. Insertion loss, measured in dB, is provided along the y-axis and in the range of interest, the values are between zero and −50 dB. It should be noted that the ranges provided in FIGS. 11 and 12 are representative only and are intended merely to show one embodiment of the present invention. The partially interdigitated combline ceramic filter design may be applied to filters at many frequencies of the elecromagnetic spectrum.

Referring to FIG. 12, the filter response shows a bandwidth of about 75 MHz at the PCS Tx (transmit) frequencies. Significantly, this filter response shows greater than 50 dB stopband attenuation in proximity to the two low side transmission zeros 1202. Moreover, this frequency response curve shows good insertion loss performance which also implies good electrical Q. FIG. 12 also proves that a good performance filter may be manufactured having a partially interdigitated combline filter design at PCS frequencies having no external shield.

Although various embodiments of this invention have been shown and described, it should be understood that various modifications and substitutions, as well as rearrangements and combinations of the preceding embodiments, can be made by those skilled in the art, without departing from the novel spirit and scope of this invention.

What is claimed is:

1. A partially interdigitated combline filter, comprising:

a filter body comprising a block of dielectric material having a top, a bottom, sides, and first and second ends;

a plurality of resonators formed by metallized through-holes extending from the top to the bottom of said filter body and spaced from said first end to said second end;

a metallization layer substantially coating the sides and ends;

a first interdigital filter section formed adjacent said first end by first and second quarter-wavelength resonators;

said first resonator being short-circuited by metallization in proximity to said bottom and being open-circuited in proximity to said top; and said second resonator being open-circuited in proximity to said bottom and short-circuited by metallization in proximity to said top;

a first combline filter section formed by said second resonator and a third quarter-wavelength resonator;

said third resonator being short-circuited by metallization in proximity to said top and open-circuited in proximity to said bottom;

a second interdigital filter section formed by said third resonator and a fourth quarter-wavelength resonator;

said fourth resonator being short-circuited by metallization in proximity to said bottom and open-circuited in proximity to said top;

a second combline filter section formed by at least said fourth resonator and a fifth quarter-wavelength resonator;

said fifth resonator being short-circuited by metallization in proximity to said bottom and open-circuited in proximity to said top;

coupling means between the quarter-wavelength resonators of each of said first and second interdigital sections; and first and second input-output pads comprising an area of conductive material on one of the side surfaces and substantially surrounded by an unmetallized area.

2. The filter of claim 1 wherein the quarter-wavelength resonators define transmission zeros.

3. The filter of claim 1 further comprising:

a loading capacitor at the open circuited end of the quarter-wavelength resonators of at least one of said combline sections and at least one of said interdigital sections.

4. The filter of claim 1 wherein the coupling means between the quarter-wavelength resonators of the first interdigital filter section comprises at least one resonator.

5. The filter of claim 1 wherein the coupling means between the quarter-wavelength resonators of the second interdigital filter section comprises at least two offset resonators.

6. The filter of claim 1 for operating at a frequency of at least 1800 MHz.

7. The filter of claim 1 wherein at least one of said first and fifth quarter-wavelength resonators comprises a shunt zero.

8. The filter of claim 1 wherein at least one of said first and fifth quarter-wavelength resonators comprises a trap to improve frequency selectivity.

9. The filter of claim 1 wherein the short-circuited end of at least one of said first and second interdigital filter sections provides a ground plane sufficient to eliminate the need for external shielding.

10. A partially interdigitated combline ceramic filter comprising:

a first combline filter section in a ceramic block having opposed ends, opposed sides, a top, and a bottom;

a metallization layer substantially coating the opposed sides and the opposed ends of said ceramic block;

first and second spaced quarter-wavelength resonators extending from said top to said bottom of said first combline filter section;

said first and second spaced resonators being open-circuited in proximity to said top and being short-circuited by metallization in proximity to said bottom;

a second combline filter section in said ceramic block adjacent said first combline filter section and having opposed ends, opposed sides, a top, and a bottom corresponding to said first combline filter section;

third and fourth spaced quarter-wavelength resonators extending from said top to said bottom of said second combline filter section;

said third and fourth spaced resonators being short-circuited by metallization in proximity to said top of said second filter section and being open-circuited in proximity to said bottom of said second filter section;

an interdigitated filter section formed by said second and third resonators; and coupling means between said second and third resonators, said coupling means being formed by offsetting said first and second combline filter sections laterally with respect to each other.

11. A partially interdigitated combline ceramic duplexer filter comprising:

first, second, and third combline ceramic filter sections formed in a common ceramic block;

said ceramic block having first and second opposed ends, opposed sides, a top, and a bottom;

a metallization layer substantially coating said opposed ends and said opposed sides;

at least first and second spaced resonators in said first combline ceramic filter section; said first and second spaced resonators being formed by metallized through-holes extending from the top to the bottom of said ceramic block, said through-holes being short-circuited at the top of said ceramic block and being open-circuited at the bottom of said ceramic block;

at least third, fourth, and fifth spaced resonators in said second combline filter section; said third, fourth, and fifth spaced resonators being formed by metallized through-holes extending from the top to the bottom of said ceramic block, said through-holes being open-circuited at the top of said ceramic block and short-circuited at the bottom of said ceramic block;

at least sixth and seventh spaced resonators in said third combline filter section; said sixth and seventh resonators being formed by metallized through-holes extending from the top to the bottom of said ceramic block, said through-holes being short-circuited at the top of said ceramic block and open-circuited at the bottom of said ceramic block;

a first interdigital ceramic filter section formed by said second and third resonators;

a second interdigital ceramic filter section formed by said fifth and sixth resonators; and coupling means between said second and third resonators and between said fifth and sixth resonators.

12. The ceramic duplex filter of claim 11 wherein said coupling means comprises at least one resonator.

13. The ceramic duplex filter of claim 12 wherein said resonator coupling means is at least one metallized ground-hole extending from the top to the bottom of said ceramic block.

14. The ceramic duplex filter of claim 11 wherein the short-circuited ends of said second and third resonators forming said interdigital filter section provide a ground plane sufficient to eliminate the need for external shielding.

15. The ceramic duplex filter of claim 11 for operating at a frequency of at least 1800 MHz.

* * * * *